US009704370B2

(12) United States Patent
Ulner

(10) Patent No.: US 9,704,370 B2
(45) **Date of Patent: *Jul. 11, 2017**

(54) FALL IMPACT AND TRAUMA SIGNAL TRANSMITTER

(71) Applicant: Eric Ulner, Buncombe, IL (US)

(72) Inventor: Eric Ulner, Buncombe, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/873,332

(22) Filed: Oct. 2, 2015

(65) Prior Publication Data

US 2016/0027279 A1 Jan. 28, 2016

Related U.S. Application Data

(63) Continuation-in-part of application No. 14/226,985, filed on Mar. 27, 2014, now Pat. No. 9,153,115.

(51) Int. Cl.

| | |
|---|---|
| ***G08B 21/00*** | (2006.01) |
| ***G08B 21/04*** | (2006.01) |
| ***G08B 25/01*** | (2006.01) |
| ***A62B 35/00*** | (2006.01) |
| ***A62B 35/04*** | (2006.01) |
| *G08B 25/00* | (2006.01) |

(52) U.S. Cl.

CPC ..... *G08B 21/0446* (2013.01); *A62B 35/0075* (2013.01); *A62B 35/04* (2013.01); *G08B 25/016* (2013.01); *G08B 25/009* (2013.01)

(58) Field of Classification Search

CPC ... A61B 5/1117; G08B 21/02; A62B 35/0018; A62B 35/0093; A62B 35/0043

USPC .... 340/679, 573.1, 673, 685, 665, 668, 457; 182/3, 18

See application file for complete search history.

(56) References Cited

U.S. PATENT DOCUMENTS

| | | | | |
|---|---|---|---|---|
| 6,394,495 | B1 * | 5/2002 | Specht | B60R 21/013 180/268 |
| 6,487,812 | B2 | 12/2002 | Johnson | |
| 7,106,205 | B2 * | 9/2006 | Graef | A62B 35/0012 182/3 |
| 7,201,619 | B1 | 4/2007 | Viggiano et al. | |
| 7,450,332 | B2 | 11/2008 | Pasolini et al. | |
| 7,463,148 | B2 | 12/2008 | Leen | |
| 2008/0060872 | A1 | 3/2008 | Wise | |

(Continued)

FOREIGN PATENT DOCUMENTS

WO 2012158554 11/2012

OTHER PUBLICATIONS

Kenyon, Mark; "ATA 2014: iHunt Fall Call by Tree Spider"; Wired to Hunt; ; http://wiredtohunt.com/2014/01/10/ata-2014-ihunt-fall-call-by-tree-spider/; Jan. 10, 2014.

*Primary Examiner* — Phung Nguyen
(74) *Attorney, Agent, or Firm* — Spencer Fane LLP

(57) ABSTRACT

A fall impact signal transmitter device is associated with a fall arrest harness to provide an alert signal when a user has experienced a fall event and is suspended in the fall arrest harness. A transmitter is disposed within a housing and is caused to issue a distress signal when actuated by an engagement member when a fall event occurs. The transmitter may be Bluetooth® enabled to permit a distress signal to be communicated by the user's own cell phone, or to permit two-way communication through the cell phone between the user and a called number.

16 Claims, 10 Drawing Sheets

(56) References Cited

U.S. PATENT DOCUMENTS

| | | | | |
|---|---|---|---|---|
| 2010/0231402 | A1* | 9/2010 | Flynt | A62B 35/0025<br>340/679 |
| 2010/0282541 | A1* | 11/2010 | Renton | A62B 1/18<br>182/234 |
| 2011/0103558 | A1* | 5/2011 | Hooten | A62B 35/04<br>379/37 |
| 2012/0101770 | A1* | 4/2012 | Grabiner | A61B 5/1116<br>702/141 |
| 2014/0008147 | A1* | 1/2014 | Jones | A62B 35/04<br>182/3 |

* cited by examiner

FALL IMPACT AND TRAUMA SIGNAL TRANSMITTER

RELATED APPLICATIONS

The present non-provisional patent application claims priority benefit of earlier-filed provisional patent application Ser. No. 61/806,233, filed Mar. 28, 2013, now expired, and non-provisional patent application Ser. No. 14/226,985, filed Mar. 27, 2014, now U.S. Pat. No. 9,153,115, issued on Oct. 6, 2015. The identified earlier-filed applications are hereby incorporated by reference into the present application.

BACKGROUND OF THE INVENTION

The present invention relates to safety apparatus in providing assistance for individuals experiencing an event arising from a fall at an elevated height. In particular, the invention relates to safety devices addressing hazards that occur when an individual uses a safety harness for preventing an individual from free-falling while conducting activities at an elevated height. The invention also has applicability for providing assistance to individuals experiencing a vehicular crash.

Many activities require an individual to work at an elevated height. A few examples of such activities include work on bridges, construction of high-rise buildings and office-building window-washing. Recreational activities also may involve an individual being positioned at an elevated height, such as hunting from a tree stand. In each of these activities, a safety harness is used to prevent the individual from free-falling to the ground. Generally, however, an individual who has partially fallen and been retained by the safety harness nevertheless is likely to remain suspended and not automatically brought to a secure position. That is, the individual generally remains dangling until assistance arrives to bring the individual into a fully controlled position such that the individual is freed from the harness and is able to move around on his own. Frequently, the individual is alone at the activity site, especially in the hunting environment, and assistance after a fall may be delayed until somebody else actually is made aware that the individual has fallen.

Being in a suspended position while in a harness for any length of time is extremely dangerous because it severely impacts the ability of the body's circulatory system to function effectively. The straps of the harness are placed under considerable tension from the weight of the person's body causing the straps to cut off circulation and blood flow. The restriction of blood to the body's upper organs, such as the heart and brain, leads to disastrous consequences. This adverse medical phenomenon associated with being suspended in a safety harness is well-known and documented. The condition is known as suspension trauma (or harness induced pathology) and is addressed by the Occupational Safety & Health Administration (OSHA) of the U.S. Department of Labor. See http://osha.gov/dts/shib/shib032404.html.

Accordingly, there is a need for a safety device for use with a fall arrest harness that can provide an alert when an individual experiences a fall event while in the harness. It is further desirable that the safety device be capable of issuing a distress signal that can be sent to an appropriate recipient, such as an emergency responder, such that help can be summoned to assist the individual in being freed from the suspended state. It is further desirable that the safety device's distress signal be compatible with a telecommunication device, such as a cell phone, such that vocal communication can occur between the individual experiencing the fall event and the emergency responder.

SUMMARY OF THE INVENTION

The present invention comprises a fall impact signal device for use by a person wearing a fall arrest harness. The signal device is rigged on the user in an arrangement such that the fall will actuate an alarm or distress signal indicating that the individual has fallen. The distress signal therefore communicates that the person is confined in the safety harness in a suspended state and is in need of emergency assistance. The safety device can be connected either directly to support line to which the safety harness is tethered, or may be connected to or integrated within the safety harness itself. In either event, a fall event will cause the alarm or signal on the signal device to be actuated. The invention is also adaptable for use with a vehicle seat belt and can deliver a distress signal upon the occurrence of a vehicular crash.

One embodiment of the signal device comprises a housing for receiving a transmitter. The transmitter is equipped with a switch member that actuates the transmitter to emit a signal. The fall event triggers the switch member in the transmitter causing the alarm signal to be issued. A transmitter engagement member is received within the housing and interacts with the transmitter to activate the transmitter switch member. A strap associated with the safety harness is received through the housing and lies in proximity to the transmitter engagement member and the signal transmitter. Under pressure from a fall event, the strap tightens causing force to be applied against the transmitter switch member to actuate the alarm signal. The alarm signal may comprise one or more types of alarms, including visual distress signals such as flashing lights and audible signals such as a siren sound.

In accordance with a further aspect of the invention, the transmitter is adapted with Bluetooth® technology whereby the alarm signal may comprise a command to a designated cell phone to place a predetermined emergency call.

In accordance with yet another aspect of the invention, the transmitter is a two way radio permitting vocal communication between the transmitter and a remote receiver.

In accordance with yet another aspect of the invention, the signal device can be adapted for use with a vehicle seat belt.

These and other features, aspects and advantages of the present teachings will become better understood with reference to the following description.

DRAWINGS

Those of skill in the art will understand that the drawings, described below, are for illustrative purposes only. The drawings are not intended to limit the scope of the present teachings in any way.

DETAILED DESCRIPTION

Figure 1:
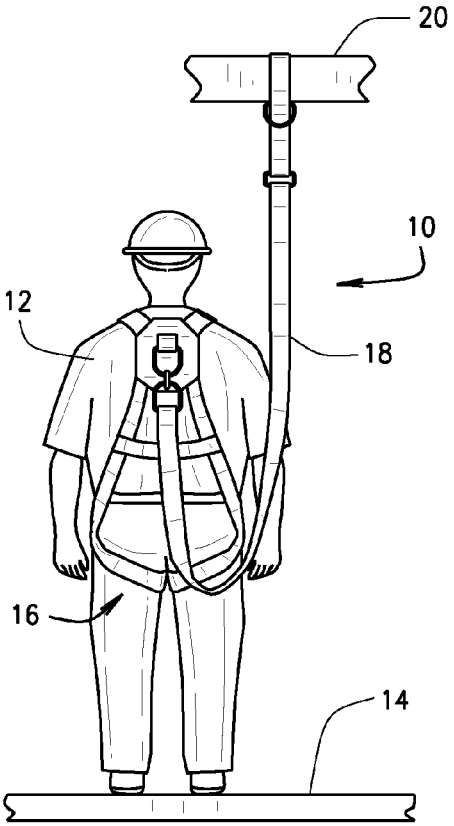
FIG. 1 is a pictorial view of a person wearing a fall arrest harness.

A fall arrest system 10 is generally shown in FIG. 1. It is used by a person 12 that performs activity at an elevated height such as on scaffold 14. A fall arrest system 10 generally comprises a harness 16 worn by person 12 and is tethered by lanyard 18 to an anchor support, such as beam 20. FIG. 1 shows the harness and lanyard connected in a "dorsal" attachment towards the back middle-shoulder area of the user. Other attachment arrangements can be such that the connection is at the front chest area of the user. The at-height environment can be any in which a person works at an elevated height.

Figure 2:
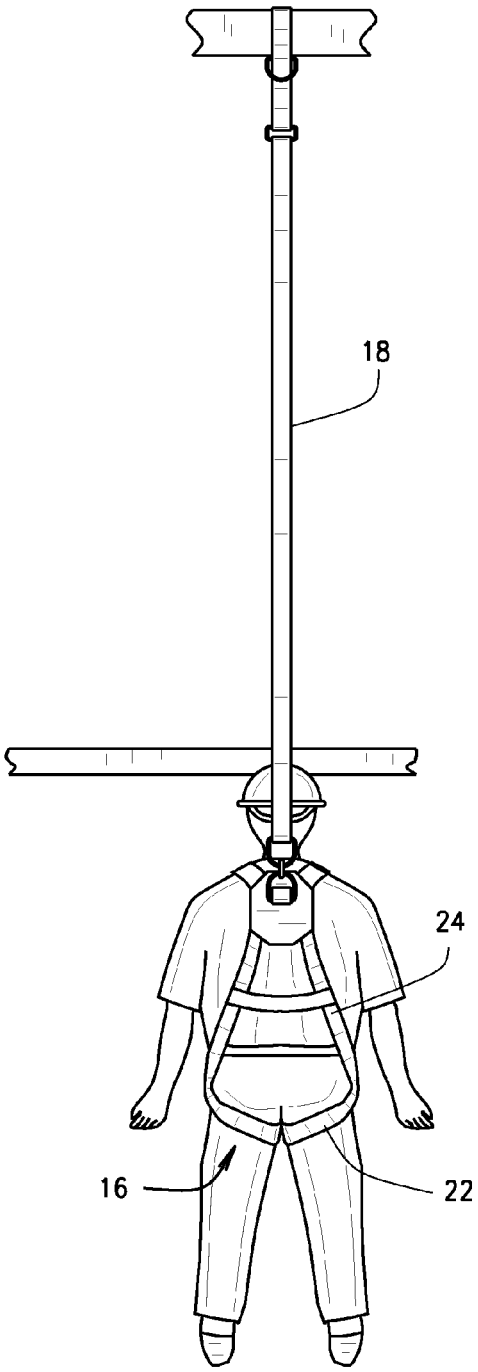
FIG. 2 is a pictorial view of a person suspended in a fall arrest harness after a fall event.

If a person wearing a fall arrest system falls while working at height (a "fall event"), the harness 16 and lanyard 18 operate to prevent the user from falling catastrophically to the ground. Some fall arrest systems are designed to slow the rate of fall so that the user does not suffer from the sudden impact upon reaching the end of the lanyard. Generally, however, the fall arrest system is limited to preventing the catastrophic fall to the ground, and is not designed to bring the user to complete safety on the ground or to a surface upon which the user may regain standing control. Accordingly, a user will still remain suspended in harness 16 above the ground as shown in FIG. 2. As the user remains suspended, his own body weight will place substantial pressure against leg straps 22 and upper body straps 24. This will cause the straps to press tightly against the user's critical arteries and veins in the leg and thoracic regions, effectively restricting the flow of blood to the user's upper organs, including the heart and brain. The restriction of the user's circulatory system will ultimately lead to suspension trauma and place the user in an extremely hazardous health situation.

The invention provides a system for emitting a distress signal upon the occurrence of a fall event experienced by a person wearing a fall arrest system. An embodiment of the invention comprises a housing 26 in which a transmitter 28 is positioned. For purposes of explanation in this particular embodiment, transmitter 28 may be a wireless Bluetooth® enabled device capable of being paired with a cell phone (not shown). An example of such a device is manufactured by the Zomm company and sold under the trademark Wireless Leash™ (www.zomm.com). This type of device provides features including a panic alarm, 911 access, and a speakerphone. Transmitter 28 is provided with a push button 34 that actuates the alarm and other transmission features when depressed. In the exploded view of FIG. 4, housing 26 comprises a base element 30 and a cover member 32. Base element 30 is provided with a compartment 36 for receiving transmitter 28. Cover member 32 engages base element 30 to enclose transmitter 28 in housing 26. Passageway 38 is configured into cover member 32 to provide a channel for strap 40 which lies adjacent to push button 34 of transmitter 28 when the housing is assembled.

Figure 3:
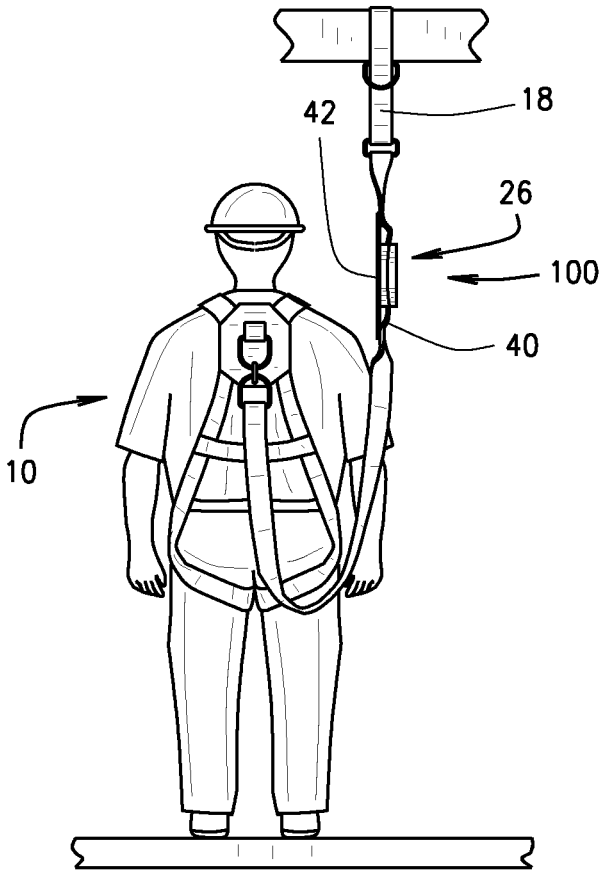
FIG. 3 is a pictorial view of a person wearing a fall arrest harness with the fall signal device of the present invention integrated into the fall arrest strap.
Figure 5:
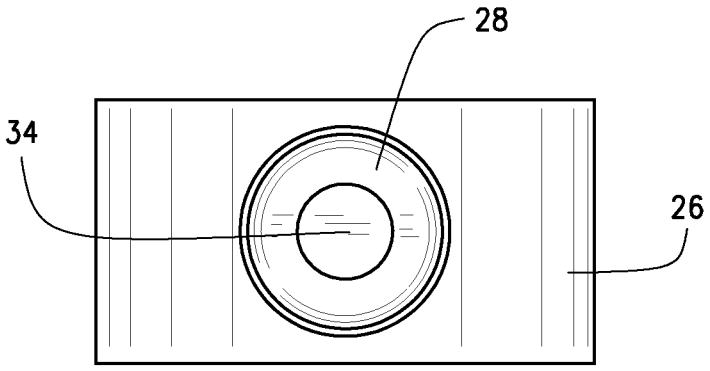
FIG. 5 is a top plan cross-sectional view of the interior of the fall signal device housing of FIG. 4.
Figure 8:
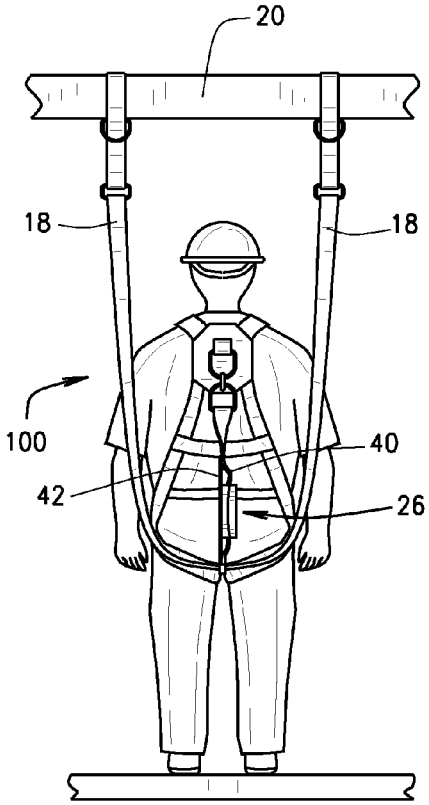
FIG. 8 is a pictorial view of person wearing the fall signal device as a separate attachment from the fall arrest harness.
Figure 9:
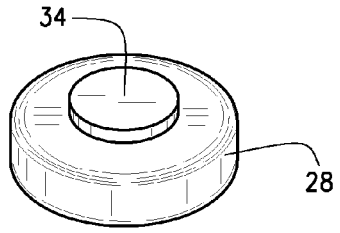
FIG. 9 is a perspective view of the transmitter device.

The arrangement of the housing 26 and strap 40 are part of the overall fall impact signal transmitter device 100 shown deployed in FIG. 3. In this arrangement strap 40 is connected in serial fashion with the tether strap 18 of fall arrest system 10. That is, housing 26 is connected to lanyard 18 by strap 40 which is placed in an intermediate position along lanyard 18. Strap 40 and lanyard 18 may be connected by conventional means such as D-rings, carabiners or snap links. In this connection, the force of a fall event is transmitted to housing 26. Alternatively, fall impact signal transmitter device 100 may also be used in connection with a Y-lanyard as shown in FIG. 8. In this arrangement, however, the fall impact signal transmitter 100 must be placed at the trunk portion of the Y-lanyard so as not to disrupt the fall arrest features of the harness.

Figure 6:
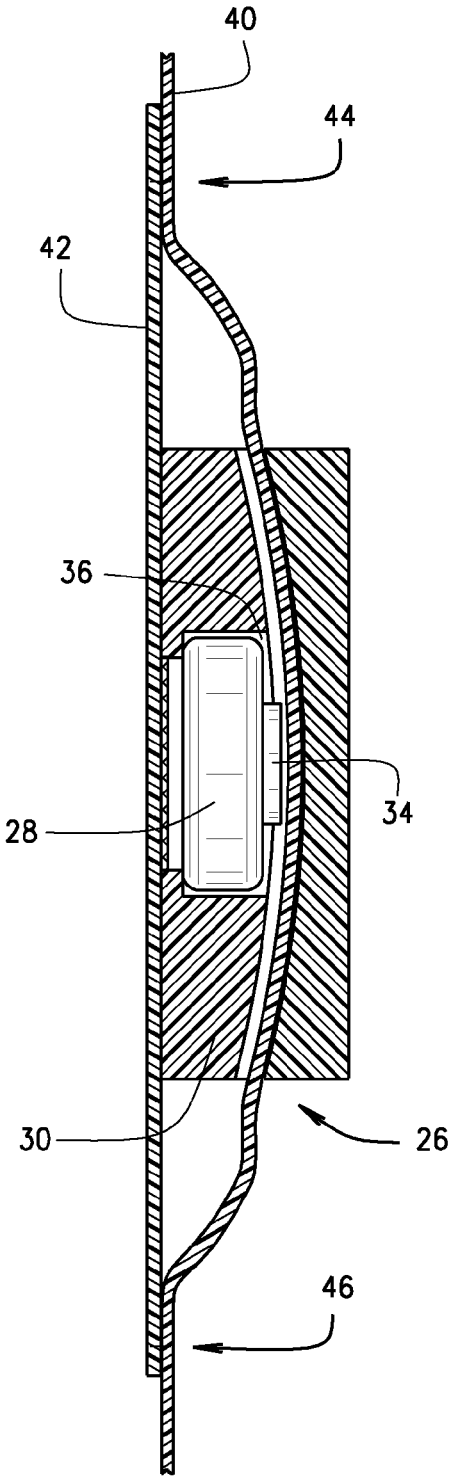
FIG. 6 is a cross sectional view in side elevation of the housing with the transmitter in recess with the engagement strap in un-tightened state engaging against the transmitter button.
Figure 7:
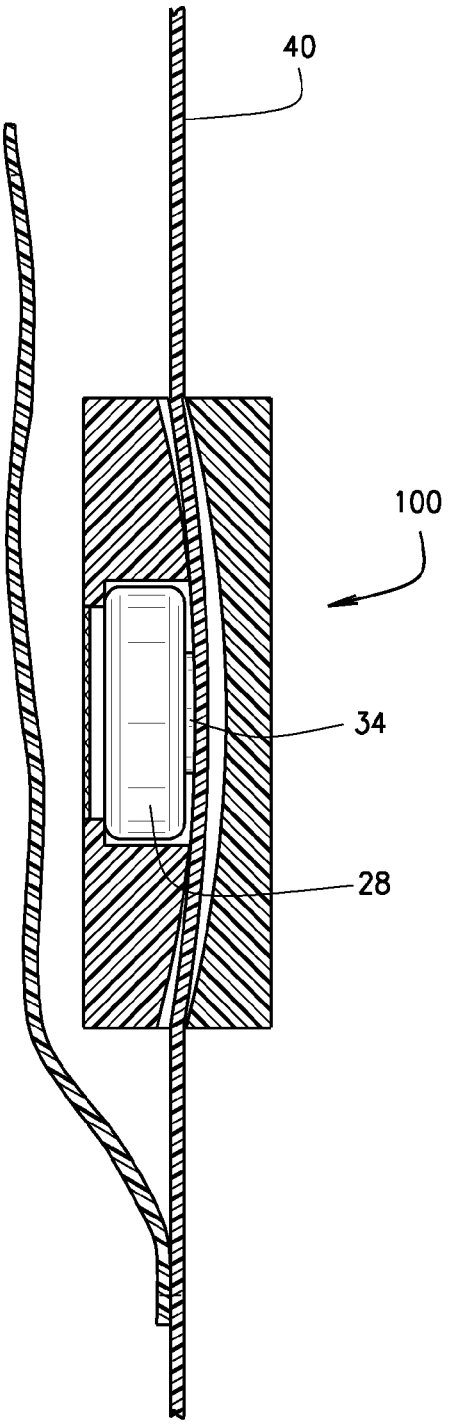
FIG. 7 is a cross sectional view in side elevation of the housing with the transmitter in recess with the engagement strap in a tightened state engaging and depressing the transmitter button.

As shown in FIGS. 6 and 7, strap 40 is adapted to engage and depress push button 34 upon the occurrence of a fall event to trigger the distress signal or other alarm feature of transmitter 28. FIG. 6 shows the arrangement when the fall impact signal transmitter device 100 is at rest, that is, at all times other than after the occurrence of a fall event. The compartment 36 of base element 30 of housing 26 provides a depth such that the push button 34 of transmitter 28 lies substantially above the plane of the opening of compartment 36. Strap 40 passes through housing 26 and lies adjacent to push button 34. That portion of strap 40 that passes through housing 26 is placed under a slight slack by using auxiliary strap 42 which is secured to strap 40 at points 44 and 46 with the slack of strap 40 placed between points 44 and 46. Under normal use conditions, strap 40 and auxiliary strap 42 provide the line of connection of fall impact signal transmitter device 100 to the fall arrest harness (for a serial attachment as shown in FIG. 3) or the anchor point (for a parallel attachment as shown in FIG. 8) and no tension is placed on that portion of strap 40 between points 44 and 46 and passing through housing 26. Straps 40 and 42 are stitched together at points 44 and 46 using seams that will break away when subjected to an impact force approximating that experienced when a person's fall is abruptly stopped by the safety harness during a fall event. When a fall event occurs, the force placed on strap 40 will cause it to be immediately tightened to eliminate the slack shown in FIG. 6. The stitchings at either, or both of, points 44 and 46 will be broken by the force causing strap 40 to tighten along its length within housing 26 as shown in FIG. 7. The tightening of strap 40 within housing 26 causes it to engage and depress push button 34 of transmitter 28 to actuate the alert signal. The stitching at points 44 and 46, however, must be resistant to breakage when exposed to forces less than two (2) kilo-newtons to avoid inadvertent triggering of the transmitter when a user does not experience a fall event but merely leans into the harness gear, which can itself place substantial force on strap 40. In an alternate embodiment, auxiliary strap 42 may be omitted if the push button 34 of transmitter 28 is itself resistant to depressive forces less than that experienced in the impact of a fall event. That is, strap 40 may actively engage push button 34 in housing 26, but push button 34 will only be depressed if it is subjected to a force at least as great as that experienced in a fall event.

Figure 4:
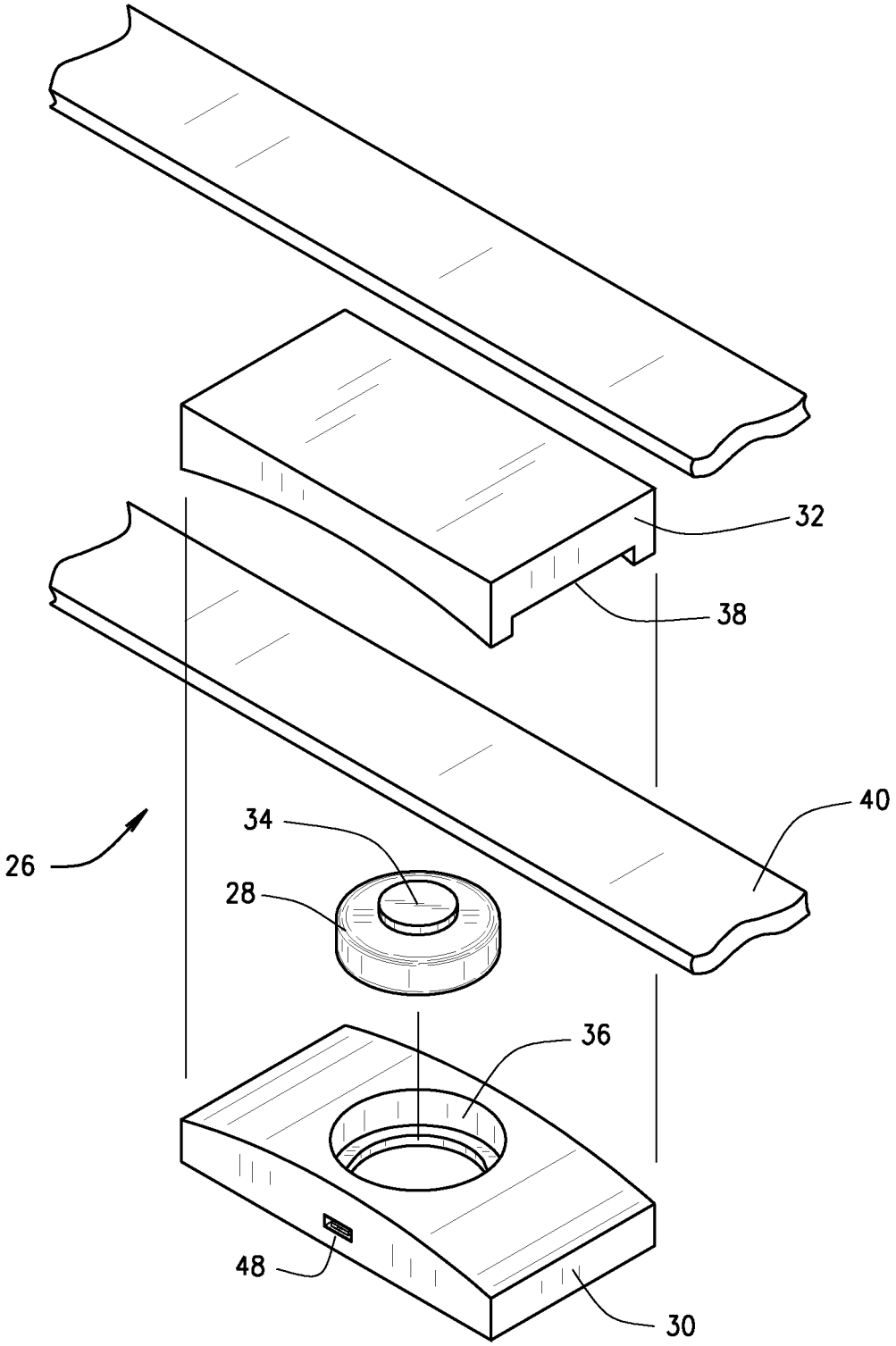
FIG. 4 is an exploded view of the housing for an embodiment of the fall signal device.
Figure 10:
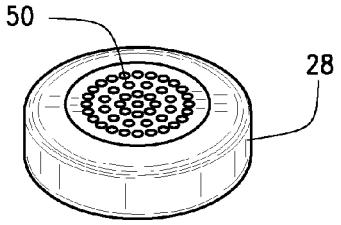
FIG. 10 is a perspective view showing the opposite side of the transmitter device.
Figure 11:
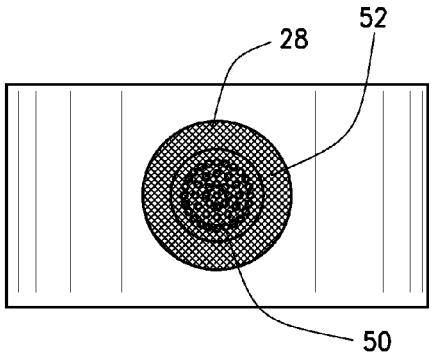
FIG. 11 is a bottom plan view of the fall signal device housing.

Transmitter 28 may have a speaker 50 on its reverse side as shown in FIG. 10. Speaker 50 may be provided with multiple functions, such as emitting an audible signal in the nature of an alarm, or serving as a speaker for two-way transmission between the user and a remote party. Housing 26 may be provided with a screen barrier 52 at the bottom of compartment 36 to permit the audible signal of transmitter 28 to emit from the housing. The housing may be provided with a USB port 48 as shown in FIG. 4 for enabling the transmitter to be accessed and/or programmed while in the housing. The USB port could be provided with a rubber seal to prevent moisture from entering the housing and transmitter.

Figure 12:
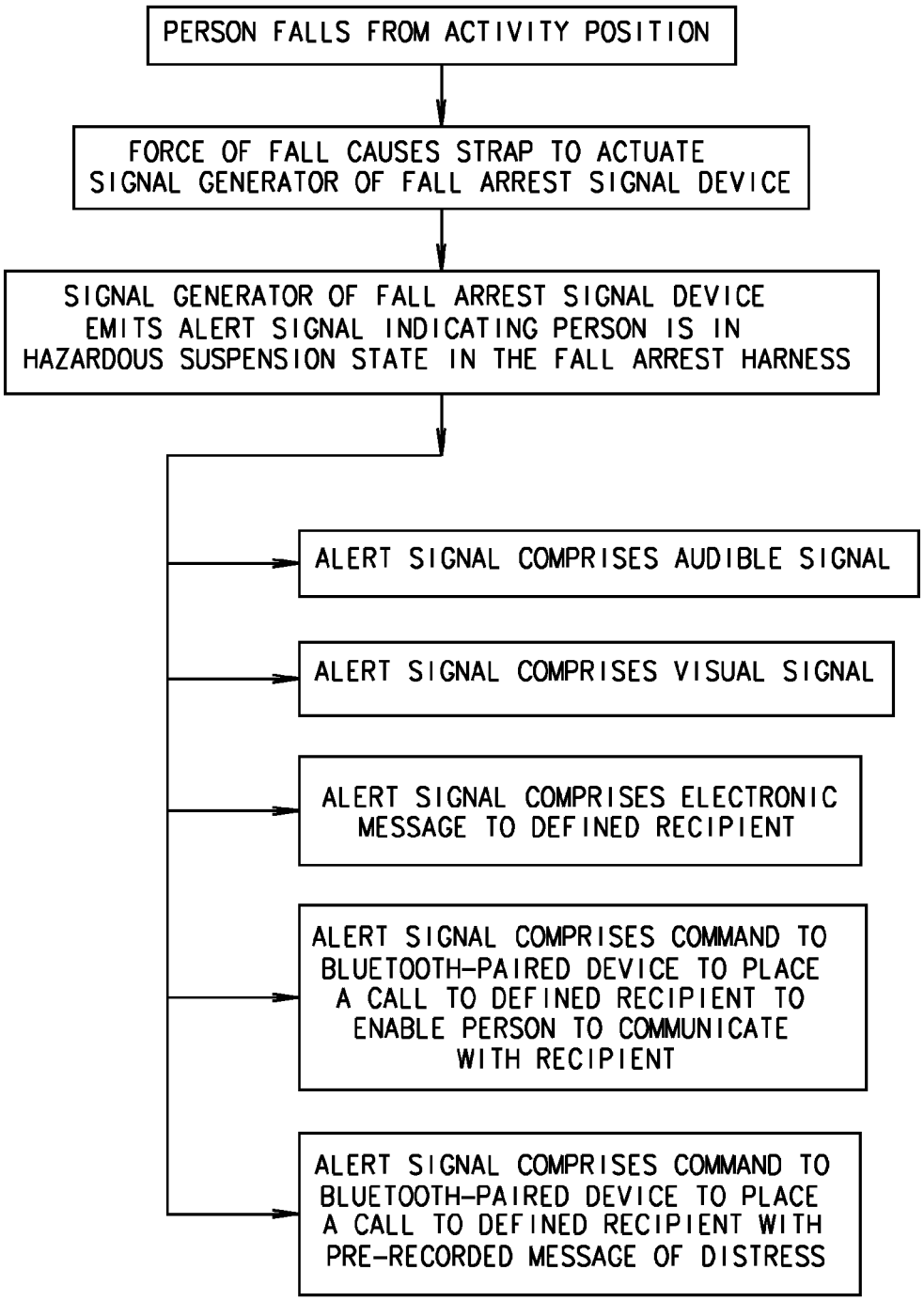
FIG. 12 is a flowchart of events in which the fall signal device is deployed during a fall event.

The employment of the fall impact signal transmitter of the present invention is set forth in the flowchart of FIG. 12. Fall impact signal transmitter device 100 is rigged in an arrangement such as in FIG. 3 where it is integrated into the straps of the lanyard 18 for the fall arrest harness. The placement of the signal transmitter device can depend on the particular transmission signals that the transmitter is capable of sending. If the transmission signals are limited to visual alerts, such as flashing lights, or a simple audible distress signal, then the housing for the signal transmitter device need not be in close proximity to the user while he is suspended. If the signal transmitter device is capable of providing two-way communication, then the signal transmitter device may optimally be placed so that it would be within reach of the user as he is suspended. The present invention may embody any of multiple distress signal types, and the transmitter may be of a type that can accommodate one or more distress signal types. Low cost alternatives can employ very simple distress signals such as flashing lights or audible sounds, such as a siren. More advanced features can include transmissions that send an electronic signal to a predetermined receiver, such as to a supervisor's pager or device capable of receiving a text message. Bluetooth® technology can permit a pairing of the transmitter device with one's own cell phone so that the user's cell phone can be triggered to place a call either to a predetermined number, such as 911, or to enable a two-way conversation. The transmitter may also be equipped with GPS whereby the person's position may be determined if he becomes unconscious and is not able to communicate his location. This feature would be beneficial in the hunting context where the hunter's spot is not known beforehand.

Figure 13:
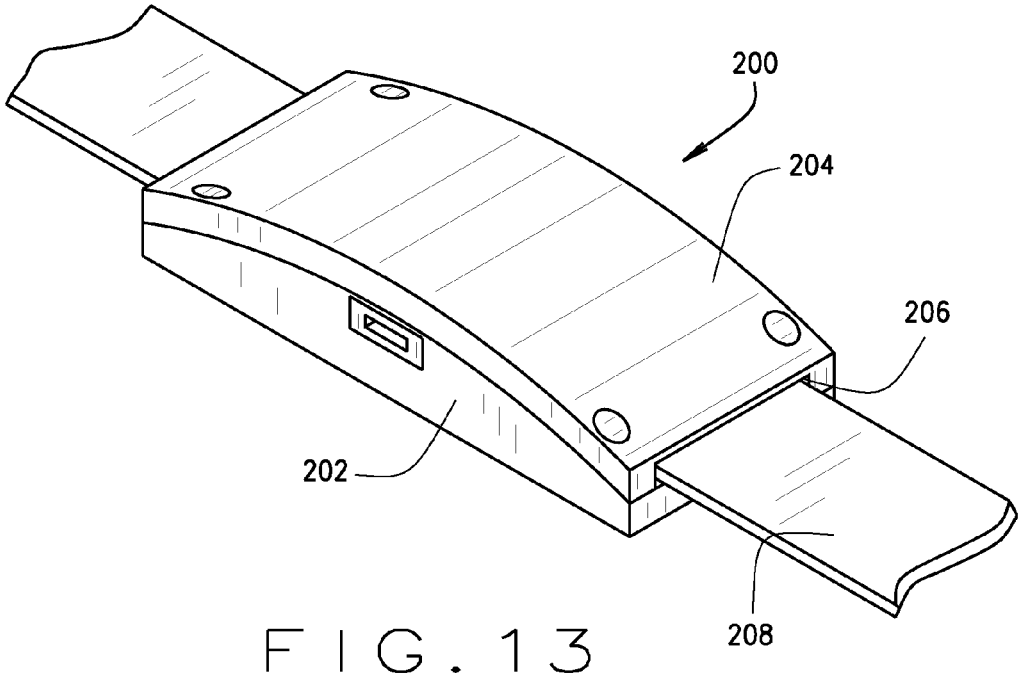
FIG. 13 is a perspective view of another embodiment of the invention.
Figure 15:
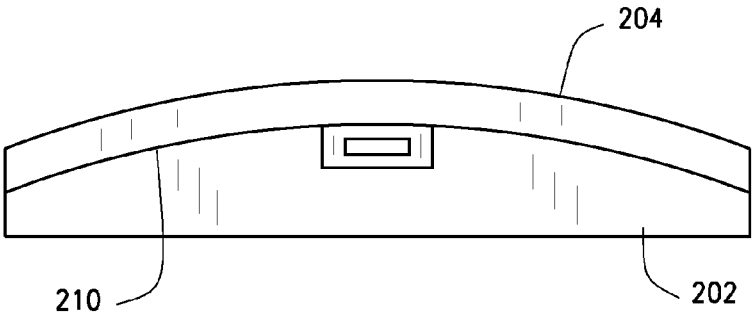
FIG. 15 is a view in side elevation of the housing of the embodiment shown in FIG. 13.

In another embodiment, the invention may be attached directly to a strap of the fall arrest harness system without the need for the tear away stitching shown in FIGS. 6 and 7. In this embodiment, the strap may pass directly through the housing 200 as shown in FIG. 13. Housing 200 comprises base element 202 and cover member 204. A recessed area is provided in an underneath side of cover member 204 so that when the housing is assembled, a channel 206 is formed between cover member 204 and base element 202. Channel 206 receives strap 208 which passes along and through the interior length of housing 200. Cover member 204 can be secured to base element 202 by screws or other appropriate fastener through holes 209 in cover member 204 for anchoring into holes 211 in base element 202. The top surface 210 of base element 202 is curved such that strap 208 follows a curved path through channel 206.

Figure 16:
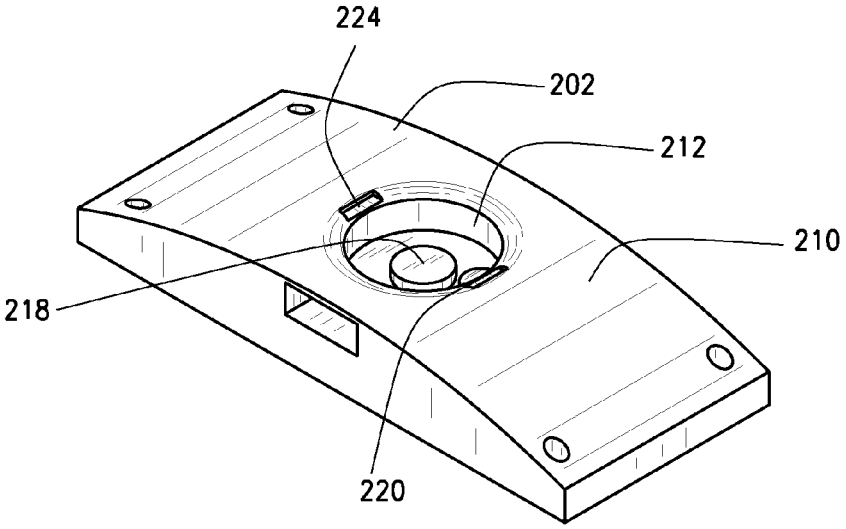
FIG. 16 is a perspective view of the embodiment shown in FIG. 13 with the top cover of the housing removed.
Figure 17:
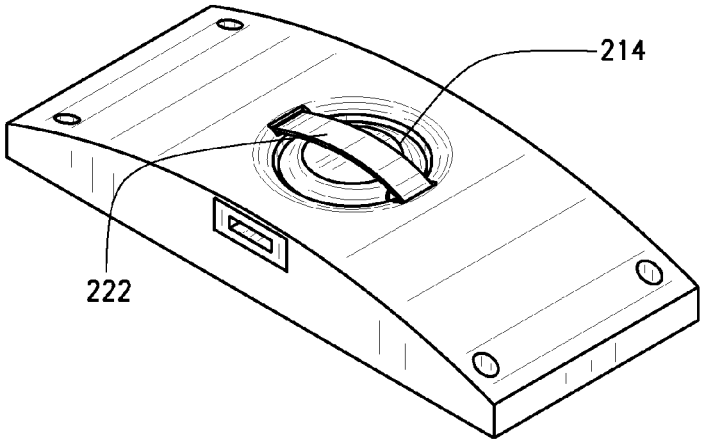
FIG. 17 is a view similar to FIG. 16 showing the signal transmitter and the transmitter engagement member placed in the housing.
Figure 18:
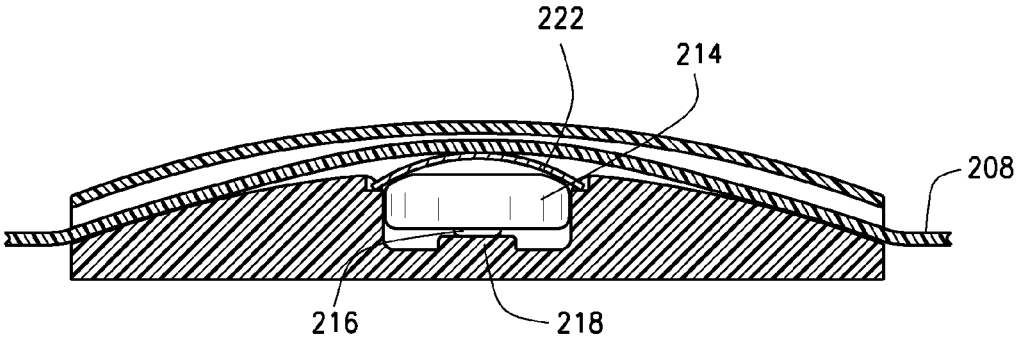
FIG. 18 is a cross-sectional view in side elevation of the housing of the embodiment shown in FIG. 13 with the strap member in a relaxed state.

Base element 202 is provided with a chamber 212 that opens towards top surface 210 as shown in FIG. 16. Chamber 212 receives signal transmitter 214 as shown in FIG. 17. In this embodiment, the transmitter 214 is placed in chamber 212 such that push button 216 for activating the signal transmitter is placed downwardly in chamber 212 as shown in FIG. 18. Push button 216 is also referred to herein as an actuator member for effecting a signal generated by the signal transmitter. A raised element 218 is disposed in the bottom of chamber 212 to align with and engage with push button 216 of the transmitter. The interior dimension of chamber 212 approximates the outer dimension of transmitter 214 for a snug fit yet permits transmitter 214 to slide within chamber 212 when under force. Resilient shims or flexible inserts may be provided on the interior walls of chamber 212 to help provide a snug fit of the transmitter within the chamber. If necessary, the interior wall of chamber 212 may define one or more insets 220 to correspond with the outer contour of transmitter 214.

A tab member 222 is received at the top opening of chamber 212 for communicating force from strap 208 to transmitter 214 for activating the distress signal upon a fall event. Tab member 222, also referred to herein as a transmitter engagement member, is positioned to engage transmitter 214 as shown in FIG. 18. Tab member 222 may have a slight curved (concave) shape so that when strap member 208 has no tension, or very low tension, placed on it, tab member 222 does not place compressive force against transmitter 214 as it lies in chamber 212. A top rim of chamber 212 may have slots 224 for receiving the ends of tab 222 to hold it in place above transmitter 214 as shown in FIGS. 16 and 17.

Figure 19:
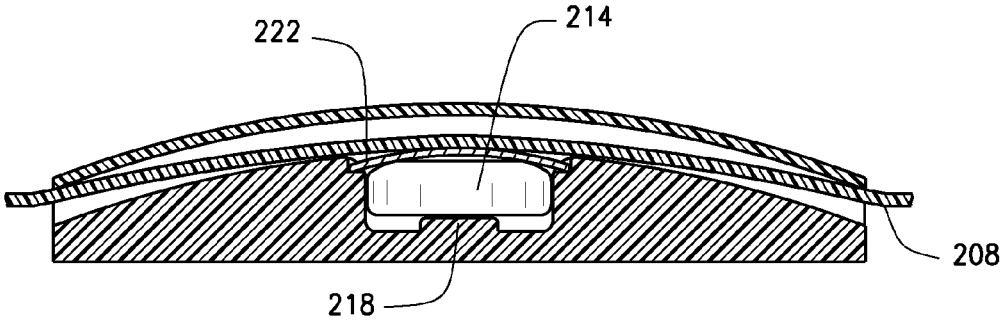
FIG. 19 is a view similar to FIG. 18 with the strap member in a tightened state.

When subjected to a force from strap 208 upon a fall event, tab member 222 bends and pushes down on transmitter 214 such that push button 216 of the transmitter is pushed against raised element 218 at the bottom of chamber 212 as shown in FIG. 19, thereby effecting a signal from the transmitter. In this configuration, a portion of tab member 222 lies above the top opening of chamber 212 and extends into channel 206 where it engages strap member 208. In this "at rest" position as shown in FIG. 18, tab member 222 merely engages, or is in a position to engage, transmitter 214, but does not present sufficient force to press transmitter 214 down within chamber 212 to urge push button 216 against raised element 218. In this "at rest" position, the transmitter is not activated. The snug fit of the transmitter within chamber 212 inhibits inadvertent sliding or moving of transmitter 214 if a fall event has not occurred. Upon the occurrence of a fall event, substantial pressure is placed on strap 208, and the curved orientation of channel 206 causes strap member 208 to place a compressive force against tab member 222, causing it to bend and press against transmitter 214, pushing it further within chamber 212 as shown in FIG. 19. When pushed further into chamber 212, push button 216 engages raised element 218, thereby activating the transmitter. Chamber 212 should have a sufficient depth to accommodate the height of transmitter 214 and the distance it travels when undergoing the activation movement shown in FIGS. 18 and 19. Also, tab member 222 should be constructed so that its degree of engagement with transmitter 214 is sufficient to push transmitter 214 down only to bring push button 216 into operative engagement with raised element 218 so as not to cause damage to the transmitter unit. Because transmitter 214 will lie completely below the top opening of chamber 212 upon a fall event, the transmitter is protected against damage from excessive compressive force from strap 208.

Tab member 222 may be constructed to be resistant to bending or breakage when exposed to forces less than that experienced in a fall event so that inadvertent triggering of the transmitter is avoided from normal movement of the harness wearer. For example, tab member 222 may be constructed of a material, such as spring steel or cast aluminum, that is resistant to mild forces. Ideally, the transmitter should only be activated after a fall event. The breakaway stitching in safety harnesses are typically constructed to withstand forces less than two kilo-newtons. When the housing is placed on a strap that is associated in series with a pack-type shock absorber, then the transmitter engagement member need not have substantial resistance. In that arrangement, tension would not be placed on strap 208 within the housing until the break-away stitching of the shock absorber straps were torn away.

When the housing is placed directly on a strap connected to a harness where a breakaway stitching is not provided, then tab member 222 should have a minimum resistance to breakage or bending so that inadvertent activation of the transmitter is not caused by the person's normal movements, such as by leaning into the strap. In a fall event, the safety strap would be expected to experience a tensile force of two kilo-newtons or greater. However, the compressive force placed against tab member 222 within housing 200 by strap 208 would be less than the tensile force placed on strap 208 itself. Also, because of the angle under which strap 208 runs through housing 200, the compressive force applied against tab member 222 during a fall event would be much less than the tensile force experienced by strap 208. Therefore, the resistance to breakage of tab member 222 should be at a value substantially less than two kilo-newtons to ensure that the signal transmitter can be activated upon a fall event. Accordingly, tab member 222 should be resistant to breakage or bending when subjected to forces less than 135 pounds, or 0.6 kilo-newtons of force.

In another embodiment, the housing for the fall impact signal transmitter may be integrated into a seat belt of a motor vehicle. The seat belt could pass through housing 200 similarly to strap 208 as discussed above. The structure and function of the device as applicable in the context of a seat belt is similar to that as described above for use with a safety harness. However, when in use with a seat belt, the device would not be used in connection with a pack-type shock absorber. Therefore, when the device is used with a seat belt, the tab member 222 should have a resistance to breakage or bending when subjected to forces less than 135 pounds of compressive force, or 0.6 kilo-newtons of force.

Figure 14:
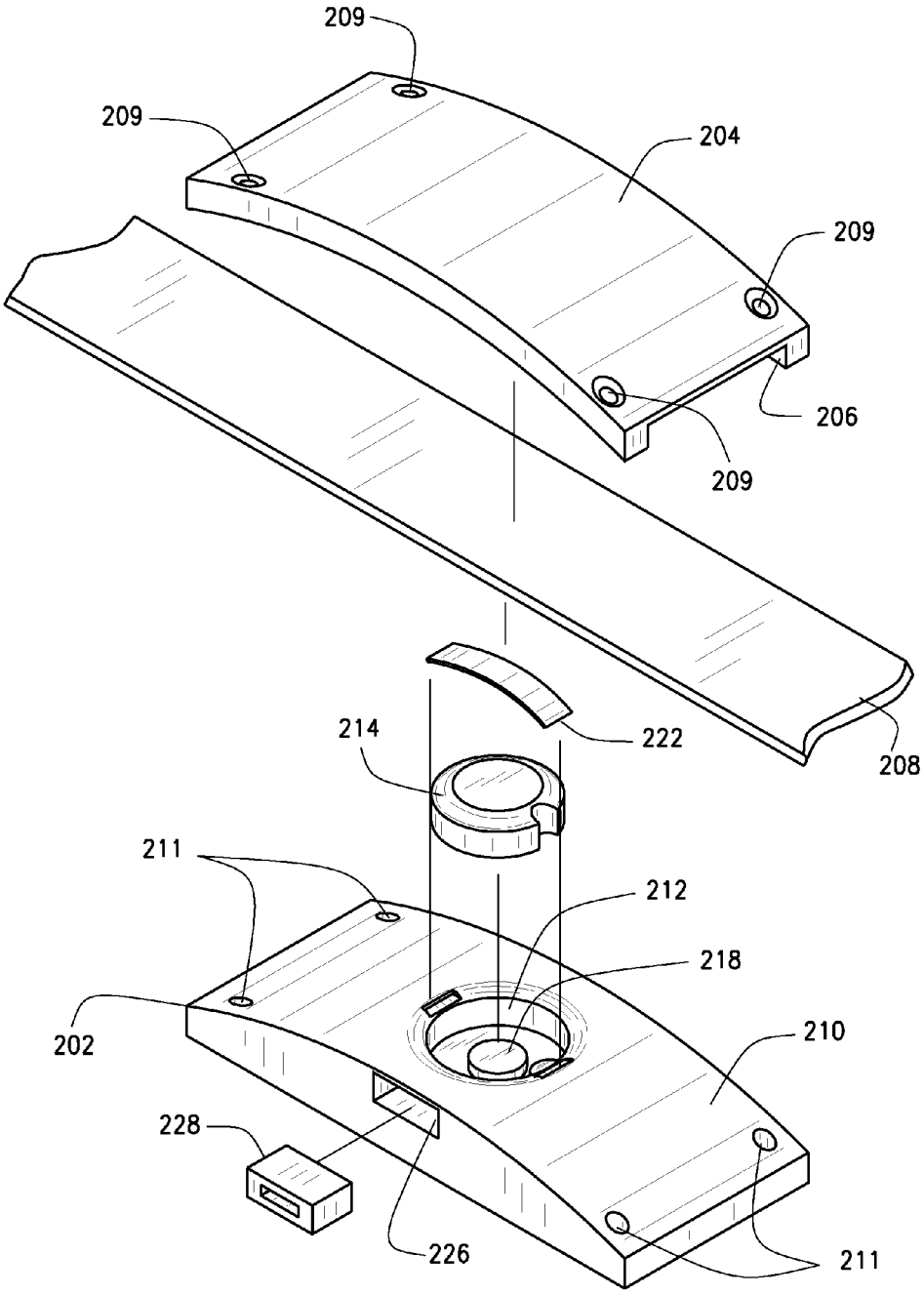
FIG. 14 is an exploded view of the housing and components of the embodiment shown in FIG. 13.

If signal transmitter 214 is programmable for reception with other devices via Bluetooth or requires periodic charging to maintain power requirements, appropriate access points can be provided in housing 200. For example, port 226 for receiving USB plug 228 can be provided in housing 200 as shown in FIG. 14 which can communicate with an appropriate outlet on transmitter 214. Also, where programming of the transmitter occurs through manipulation of push button 216, appropriate access holes can be provided on the underneath side of housing 200 and through raised element 218 in the bottom of chamber 212 to provide access to push button 216 (not shown).

The detailed description set-forth above is provided to aid those skilled in the art in practicing the present invention. However, the invention described herein is not to be limited in scope by the specific embodiments herein disclosed because these embodiments are intended as illustration of several aspects of the invention. Any equivalent embodiments are intended to be within the scope of this invention. Indeed, various modifications of the invention in addition to those shown and described herein will become apparent to those skilled in the art from the foregoing description which do not depart from the spirit or scope of the present inventive discovery.

The invention claimed is:

1. An apparatus for effecting a distress signal upon an event comprising a fall of a person while wearing a fall arrest harness connected by a line member to a support, the apparatus comprising:

a housing, a signal transmitter, and a transmitter engagement member, the signal transmitter being contained within the housing, the signal transmitter having an actuator member for effecting a signal generated by the signal transmitter, the transmitter engagement member being positioned within the housing in proximity to the signal transmitter, the housing receiving a strap member operably connected to the line member connected to the harness, the transmitter engagement member being adapted to receive and transmit a force generated by a tightening of the strap member upon the event comprising the fall of a person wearing the fall arrest harness, whereby upon a fall arrest the transmitter engagement member transmits force to the signal transmitter to trigger the actuator member of the signal transmitter to generate the signal.

2. The apparatus of claim 1 in which the strap member is disposed within the housing in a curved orientation with respect to the transmitter engagement member, whereby a tightening of the strap member urges the strap member against the transmitter engagement member.

3. The apparatus of claim 2 in which a shape of the transmitter engagement member is alterable when subjected to force, whereby a change in shape of the transmitter engagement member upon an application of pressure from the strap member causes the transmitter engagement member to push against the signal transmitter to trigger the actuator member.

4. The apparatus of claim 3 in which the transmitter engagement member is resistant to forces less than 0.6 kilo-newtons.

5. The apparatus of claim 2 in which the housing defines a chamber for receiving the signal transmitter, the signal transmitter being positioned within the chamber so that the actuator member faces a bottom of the chamber, the bottom of the chamber having an actuator engagement member disposed therein, the transmitter engagement member being positioned between the signal transmitter and the strap member, whereby upon a fall arrest the strap member is forced against the transmitter engagement member thereby pushing the signal transmitter towards the bottom of the chamber to cause the actuator member to operably engage the actuator engagement member to generate the signal.

6. The apparatus of claim 5 in which the chamber receives the signal transmitter at a depth therein upon engagement with the transmitter engagement member to prevent damage to the signal transmitter from force from the strap member.

7. The apparatus of claim 1 in which the signal generated is one selected from the group consisting of an audible sound, a visual signal, an electronic message delivered to a defined recipient, a voice-generated communication to a defined recipient, and a pre-recorded message for delivery to a defined recipient.

8. The apparatus of claim 1 in which the housing provides an opening for accessing the signal transmitter for power charging.

9. The apparatus of claim 1 in which the housing provides an opening for accessing the signal transmitter for electronic programming.

10. An apparatus for effecting a distress signal on behalf of a person experiencing a vehicular crash while wearing a seat belt, the apparatus comprising:

a housing, a signal transmitter, and a transmitter engagement member, the signal transmitter being contained within the housing, the signal transmitter having an actuator member for effecting a signal generated by the signal transmitter, the transmitter engagement member being positioned within the housing in proximity to the signal transmitter, the housing receiving a portion of the seat belt, the transmitter engagement member being adapted to receive and transmit a force generated by a forceful tightening of the seat belt, whereby upon the occurrence of the vehicular crash the transmitter engagement member transmits force to the signal transmitter to trigger the actuator member of the signal transmitter to generate the signal.

11. The apparatus of claim 10 in which the transmitter engagement member will only transmit a force to the signal transmitter when the transmitter engagement member is subjected to a force greater than 0.6 kilo-newtons.

12. The apparatus of claim 10 in which the seat belt is disposed within the housing in a concave orientation with respect to the transmitter engagement member, whereby a tightening of the seat belt urges the seat belt against the transmitter engagement member.

13. The apparatus of claim 12 in which a shape of the transmitter engagement member is alterable when subjected to force, whereby a change in shape of the transmitter engagement member upon an application of pressure from the seat belt causes the transmitter engagement member to push against the signal transmitter to trigger the actuator member.

14. The apparatus of claim 13 in which the transmitter engagement member is resistant to forces less than 0.6 kilo-newtons.

15. The apparatus of claim 13 in which the housing defines a chamber for receiving the signal transmitter, the signal transmitter being positioned within the chamber so that the actuator member faces a bottom of the chamber, the bottom of the chamber having an actuator engagement member disposed therein, the transmitter engagement member being positioned between the signal transmitter and the seat belt, whereby upon a vehicular crash the seat belt is forced against the transmitter engagement member thereby pushing the signal transmitter towards the bottom of the chamber to cause the actuator member to operably engage the actuator engagement member to generate the signal.

16. The apparatus of claim 10 in which the signal generated is one selected from the group consisting of an audible sound, a visual signal, an electronic message delivered to a defined recipient, a voice-generated communication to a defined recipient, and a pre-recorded message for delivery to a defined recipient.

* * * * *